United States Patent [19]

Grundfest

[11] 4,348,548

[45] * Sep. 7, 1982

[54] INSULATOR FOR COVERING ELECTRICAL CABLES

[75] Inventor: Michael A. Grundfest, Forest Hills, N.Y.

[73] Assignee: Thomas & Betts Corporation, Raritan, N.J.

[ * ] Notice: The portion of the term of this patent subsequent to Mar. 10, 1998, has been disclaimed.

[21] Appl. No.: 74,428

[22] Filed: Sep. 11, 1979

[51] Int. Cl.[3] ..... H01R 9/07

[52] U.S. Cl. ..... 174/88 R; 174/117 FF; 174/117 A; 428/138

[58] Field of Search ..... 174/88 R, 117 F, 117 FF, 174/117 A, 138 R, 138 G; 428/138

[56] References Cited

U.S. PATENT DOCUMENTS 3,551,270 12/1970 Sharkey ..... 428/138
3,989,338 11/1976 Gosser ..... 174/112 X
4,143,931 3/1979 Skare ..... 174/117 FF X
4,219,928 9/1980 Kuo ..... 174/117 FF X
4,258,974 3/1981 Kuo et al. ..... 174/36 X

*Primary Examiner*—B. A. Reynolds
*Assistant Examiner*—David A. Tone
*Attorney, Agent, or Firm*—Robert M. Rodrick; Salvatore J. Abbruzzese; Jesse Woldman

[57] ABSTRACT

An insulator for covering an electric cable has circular recesses for receiving any portions of a connector which extend beyond a surface of the cable covered by the insulator. If the connector extends between overlapping portions of a pair of cables, the connector and the overlapping portions of the cables can be completely enveloped by sandwiching them between a pair of insulators. The diameter of each recess is chosen so as to closely accommodate the extending portions of its associated connector and to provide a substantial barrier of insulation about the connector out to the edges of the cables being joined to prevent moisture, dirt and other contaminents from reaching the connector and causing its degradation or shorting.

17 Claims, 7 Drawing Figures

FIG. 1
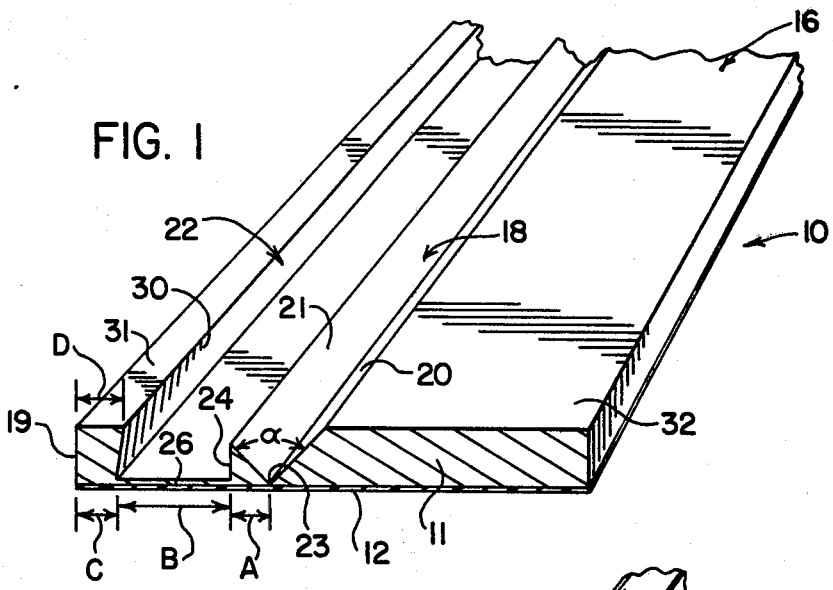
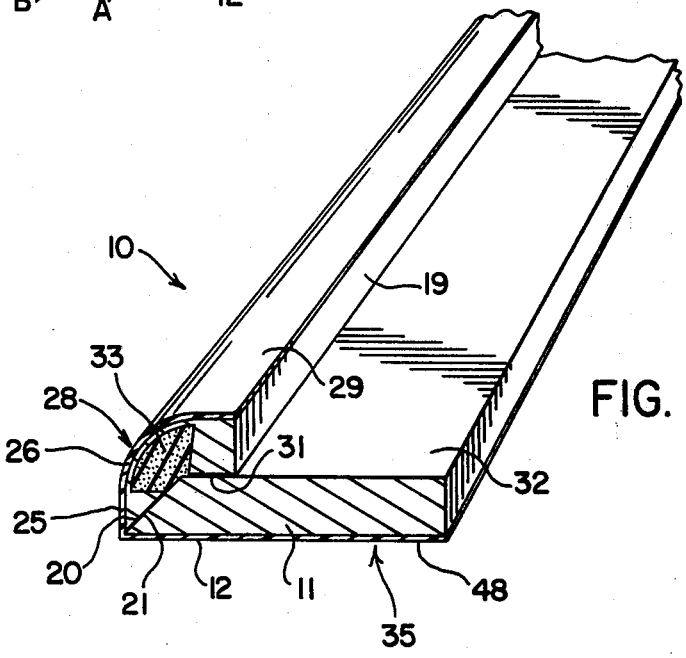
FIG. 2

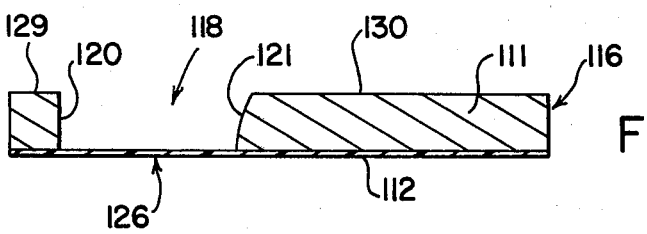
FIG. 5
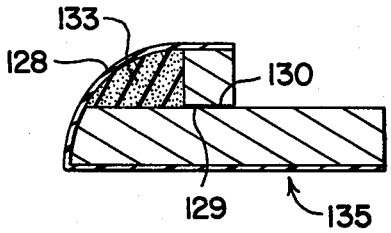
FIG. 6
FIG. 7
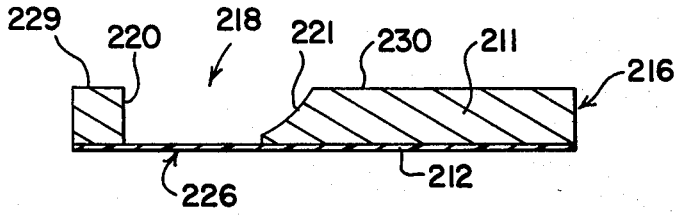
FIG. 8
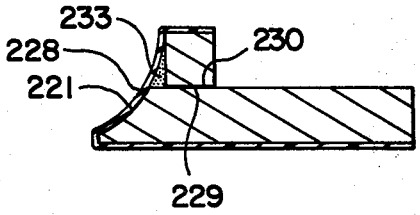

INSULATOR FOR COVERING ELECTRICAL CABLES

FIELD OF THE INVENTION

The present invention relates to insulators for covering electric cables and, more particularly, to such insulators which are especially adapted for use in connection with flat multiconductor cables.

BACKGROUND OF THE INVENTION

In my U.S. Pat. No. 4,255,612, issued on Mar. 10, 1981, entitled "Insulator for Covering Electric Cables," which is owned by the assignee of the present invention, there is disclosed a technique for insulating the joints between the conductors of two flat multiconductor cables. The specification of that copending application is incorporated into this specification by reference thereto herein.

Briefly, a series of joints between selected conductors of two overlapping flat multiconductor cables are formed using metallic connectors which extend beyond the surface of at least one of the cables. The bare metallic connectors in contact with energized electrical conductors themselves become electrically "hot" and can cause anyone who, directly or indirectly, contacts such connectors to receive a severe electrical shock.

In my earlier application, it was proposed to electrically insulate the connectors by covering them with a flat sheet of relatively flexible electrical insulation supported by an insulating spacer of a thickness sufficient to accommodate the protruding portions of the metallic connectors. The spacers, caused to adhere to the surface of the cables themselves, served to provide a sufficient insulation barrier to prevent tracking across the cable surfaces from connector to connector. This was true despite the large size of the holes in the insulator to accommodate the connectors regardless of their orientation.

The flat multiconductor cable constructed in accordance with the teaching in U.S. Pat. No. 4,219,928 issued to Kuo on Sept. 2, 1980 and owned by the assignee of the instant invention, and by this reference made a part hereof, have a series of parallel flat, insulated conductors separated from adjacent conductors by flattened depressed regions of insulation only which, due to the presence of a score line, lend themselves to tearing should it be desired to separate the conductors from one another. These flattened, depressed regions are significantly thinner than the adjacent conductor insulation portions of the cable. As a result, the relatively thick insulating spacers placed on the conductor insulation fail to conform to the depressed regions leaving pathways between the cable surface and the insulating spacers where moisture, dirt or other contaminants can enter. Due to the size of the holes in the insulating spacers, they often overlap the depressed regions permitting the connectors to be subjected to any moisture, dirt or contaminants contained therein, leading to a shorting of or other injury to the joints and cables.

SUMMARY OF THE INVENTION

The present invention overcomes many of the disadvantages and shortcomings of the device discussed above by providing an insulator with a spacer having round apertures or holes therein which closely conform to the maximum profile of the metallic connector oriented only in a selected direction and so positioned in the cable as to permit a significant insulation barrier about the connector to be created without extending into the depressed regions to either side of the conductor. With such an arrangement, any moisture, dirt or other contaminants will not be permitted to leave the depressed region and enter into the aperture in which a connector is placed. The inclusion of positioning apertures and slots in the insulators permit them to be properly placed above and below the joints employing a tool of the type described and claimed in U.S. Pat. No. 4,280,279, issued on July 28, 1981, entitled "Alignment Tool" and owned by the assignee of the instant invention. It is an object of this invention to provide an improved insulator for flat multiconductor cables.

It is another object of this invention to provide an improved insulator that also seals the connectors of two flat multiconductor cables from the surrounding environment.

It is still another object of this invention to provide insulators which can be simply placed upon a flat multiconductor cable using a simple alignment tool.

It is still another object of this invention to provide an insulator with connector receiving apertures which closely conform to the profile of the connector and permit a seal to be created wholly on the surface of the joined conductors.

Other objects and features of the invention will be pointed out in the following description and claims and illustrated in the accompanying drawings, which disclose, by way of example, the principle of the invention, and the best mode which has been contemplated for carrying it out.

BRIEF DESCRIPTION OF THE DRAWING

In the drawings in which similar elements are given similar reference characters.

FIG. 1 is a top plan view of an insulator for covering electric cables constructed in accordance with the concepts of the invention.

FIG. 2 is a side elevational view, in section, of the insulator of FIG. 1 taken along the lines of 2—2 in FIG. 1.

FIG. 5 is a side elevation, in section, of a flat multiconductor cable with an insulator constructed in accordance with the prior art adhered thereto.

FIG. 6 is a side elevation, in section, of a flat multiconductor cable with an insulator constructed in accordance with the invention adhered thereto.

FIG. 7 is a side elevation, in section, of a joint between two flat multiconductor cables insulated with insulators constructed in accordance with the invention adhered thereto.

DESCRIPTION OF THE PREFERRED EMBODIMENT

Figure 3:
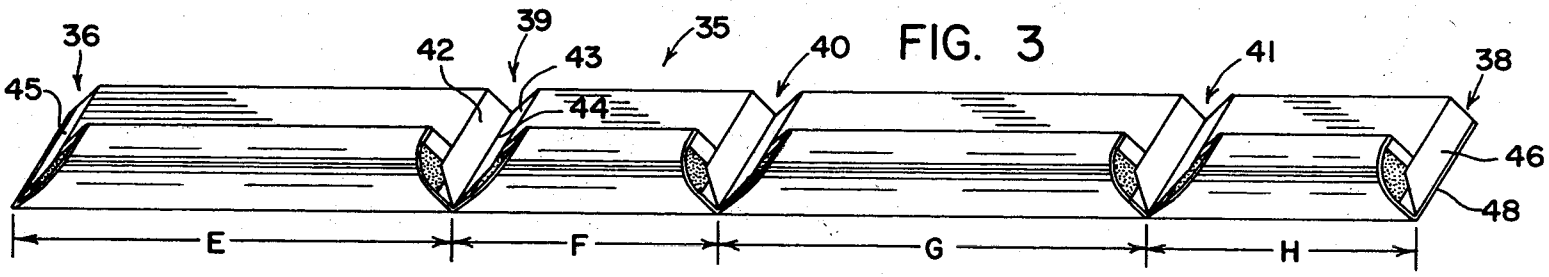
FIG. 3 is a top plan view of two overlapping flat multiconductor cables coupled to one another by a series of connectors.
Figure 4:
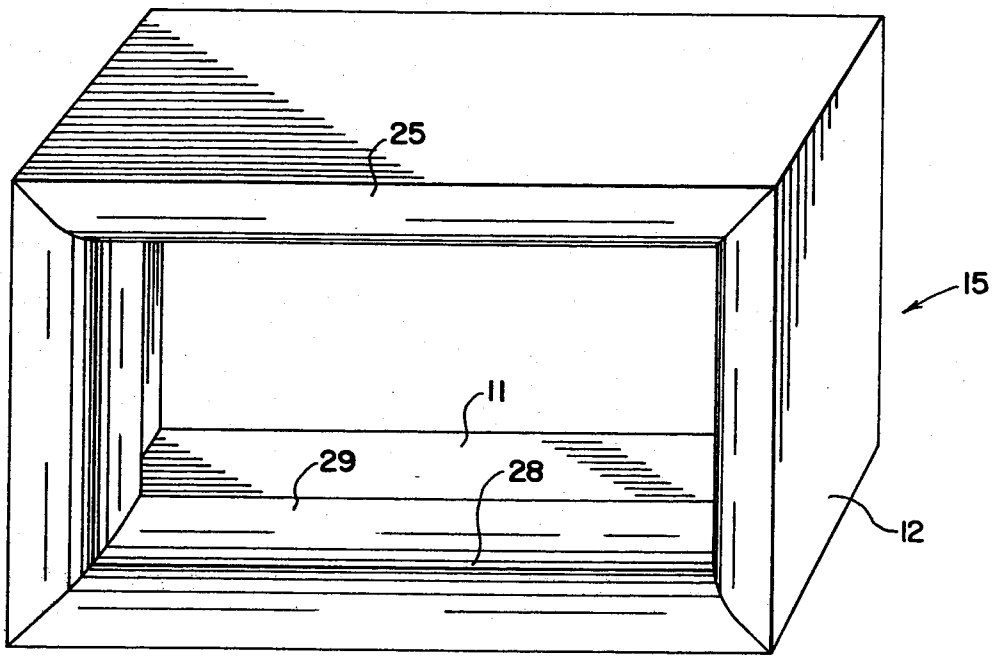
FIG. 4 is a side elevation, in section, of one of the flat multiconductor cables of FIG. 3 taken along the lines 4—4.

Turning now to FIGS. 3 and 4, a first flat multiconductor cable 110 has its individual conductors 112, 114, 116 and 118 joined to like individual conductors 122, 124, 126 and 128, respectively, of a second flat multiconductor cable 120 by the connectors 132, 134, 136 and 138, respectively. As is best seen in FIG. 4, the conductors are generally rectangular and are covered on both long sides by layers of insulation 130 and 140. The layers of insulation 130 and 140 may be adhered to themselves in the interstices between adjacent conductors as at 142, 144, 146 and at the cables ends as at 148 and 150, only ends 148 and 150 being shown in the drawing as adhered. In that there is no conductor at such locations, a flattened, depressed region is created having a width significantly less than the adjacent areas where a conductor is located resulting in a natural trough or passage along the longitudinal axis of the cable 110. Similar depressed regions are found in cable 120 as at 152, 154 and 156 and at the cable ends 158 and 160. A score line, such as 162 in depressed region 142, extends down the center of each of the depressed regions to permit the individual conductors to be separated from the full cable. Thus, conductor 112 can be removed from cable 110 by tearing along score line 162 in the depressed region 142.

As stated above, the presence of a bare metallic connector such as 132, 134, 136 or 138 engaging an energized conductor such as 112, 114, 116, 118, 122, 124, 126 or 128 itself becomes electrically "hot" so that one contacting such a connector could receive a severe electrical shock. To prevent this from happening, an insulator of the type set out in my U.S. Pat. No. 4,255,612 and shown in FIG. 5, can be employed. Insulator 10 includes a spacer 12 of insulating material covered on one surface by a thin clear film of electric insulation 14 and on the other by a layer of pressure-sensitive adhesive 18. At selected locations, holes 32 extend through spacer 12 to accommodate the connectors which protrude beyond the cables which the connectors join. The holes 32 are large enough to accept the connector in either of its two possible mirror positions. As can be clearly seen in FIG. 5, when an insulator 10 according to the above application, is placed over a flat multiconductor cable 110 some of the holes 32 extend beyond their associated conductors and over the depressed regions. Thus, hole **32*c* extends over depressed region 142, while hole 32*d* overlies a portion of depressed region 144 and hole 32*e* extends over a portion of depressed region 146. Any moisture, dirt or other contaminants which are deposited upon the surface of the cable 110 are able to travel down one of the depressed regions 142, 144 or 146 and thus contact exposed connectors (not shown) in the holes 32*b*, 32*c* or 32*d*** respectively. Such moisture, dirt or other contaminants could short out the connection or lead to the deterioration of the connector or joint.

Referring now to FIGS. 1 and 2, an insulator 164 constructed in accordance with the concepts of the invention is shown. Insulator 164 consists of a spacer layer 166 having a thickness equal to the projection of a connector extending above the surface of the cable to be insulated. Within spacer 166 are a series of round holes 168 positioned at all of the necessary interconnect positions for joining two flat multiconductor cables. The holes 168 are significantly smaller than the holes 32 of my copending application due to the fixing of the positions of the connectors to the single orientation shown in FIG. 3. It should be understood that the holes 168 could take on any other desirable shape such as that of the connector itself, etc. Round holes were chosen because of manufacturing simplicity. Over the top of a portion of spacer 166 is placed a thin, clear insulating layer 170 laminated thereto while a layer of pressure-sensitive adhesive 172 is placed on the bottom of spacer 166 and protected until use by a release layer 174. A circular aperture 176 and an elongated slot 178 are placed in spacer 166 to enable it to be positioned upon the tool which is the subject of my patent, U.S. Pat. No. 4,280,279, issued on July 28, 1981 and entitled "Alignment Tool." This tool aligns the insulator 164 with the flat multiconductor cables it is to insulate.

Turning to FIG. 6, the installation of insulator 164 to flat multiconductor cable 110 is shown. If can be appreciated that each of the holes **168*a*, 168*b*, 168*c* and 168*d* are now centered over its respective conductor 112, 114, 116 and 118. The holes are not permitted to extend over any of the depressed regions 142, 144 and 146 thus sealing the connectors in the holes 168*a*, 168*b*, 168*c* and 168*d* from any moisture, dirt or other contaminants which might be present in the depressed regions 142, 144 or 146. In each instance, a substantial portion of the insulation between the holes 168 extends between the holes and the edges of the depressed region insuring a seal to prevent the entry of any moisture, dirt or other contaminants into the holes 168. The connectors 132, 134, 136 and 138 will be set centrally into the overlapped conductors so that approximately equal insulative barriers extend to either side of the holes 168** to the adjacent depressed regions.

FIG. 7 shows a completed splice of flat multiconductor cables 110 and 120 with insulators 166 placed below and atop the joint formed by connector 132.

While there have been shown and described and pointed out the fundamental novel features of the invention as applied to the preferred embodiments, it will be understood that various omissions and substitutions and changes of the form and details of the device illustrated and in its operation may be made by those skilled in the art, without departing from the spirit of the invention.

The embodiment of the invention in which an exclusive property or privilege is claimed are defined as follows:

1. In combination, a first multiconductor cable and a second multiconductor cable, said first and second cables each having conductor portions of a first predetermined thickness each conductor portion being separated from adjacent conductor portions by a flat depressed region of a second predetermined thickness less than said first predetermined thickness, said first and second cables having common overlapping portions and with specific conductors of said first multiconductor cable joined to specific conductors of said second multiconductor cables by means of electrical connectors which extend above the surfaces of the conductors portions a third predetermined height, and a pair of insulators positioned so as to sandwich said overlapping portions of said first and second multiconductor cables therebetween, said insulator including means forming an insulating barrier between said flat depressed regions and said connectors.

2. A combination according to claim 1, wherein each of said insulators defines at least one aperture for receiving a portion of said at least one connector which extends above a conductor portion of said overlapping portions of said cables.

3. A combination according to claim 1 wherein said insulator includes spacer means surrounding each connector and defining said barrier means, said spacer means being located on said conductor portions.

4. A combination according to claim 3 further including an insulating member on said spacer means and supported over said connectors.

5. A combination according to claim 3 wherein said surrounding spacer means defines an opening in registry with each of said conductor portions, the size of each such opening being less than the distance between said depressed regions along the lateral direction of said cables.

6. A combination according to claim 5 wherein said openings are substantially circular.

7. A combination according to claim 1 further including adhesive means joining said insulators and said cables.

8. An insulator for insulating the junctures between connected conductors of two or more substantially flat multiconductor cables comprising a spacer member having first and second opposed surfaces, said spacer member having a plurality of openings extending in an ordered pattern through said first and second surfaces and at least two spaced alignment apertures in configuration different from one another, an insulating member on said first surface of expanse sufficient to cover said openings and adhesive means on said second surface.

9. An insulator according to claim 8 further comprising liner means removably attached to said adhesive means.

10. An insulator according to claim 8 wherein said spacer member is substantially planar.

11. An insulator according to claim 10 wherein said spacer member defines a predetermined geometric area and wherein said insulating member lies within the perimetric boundaries of said geometric area excluding said alignment apertures whereby said alignment apertures are exposed.

12. An insulator according to claim 8 wherein said openings are substantially circular.

13. An insulator according to claim 8 wherein said alignment apertures comprise a round aperture and an elongated slot spaced therefrom, said round aperture and said slot extending through said first and second surfaces of said spacer member.

14. An insulator according to claim 8 wherein a first plurality of openings lie along a substantially straight line.

15. An insulator according to claim 14 wherein at least one further opening lies offset from said line.

16. An insulator according to claim 14 wherein a second plurality of openings, including one of said first plurality of openings lies in a second substantially straight line intersecting said first-mentioned straight line.

17. An insulator according to claim 8 wherein said insulating member comprises a substantially transparent layer.

* * * * *